US007540180B2

(12) United States Patent
Golovashchenko et al.

(10) Patent No.: US 7,540,180 B2
(45) Date of Patent: Jun. 2, 2009

(54) APPARATUS FOR ELECTROMAGNETIC FORMING WITH DURABILITY AND EFFICIENCY ENHANCEMENTS

(75) Inventors: Sergey Golovashchenko, Beverly Hills, MI (US); Vladimir Dmitriev, Westland, MI (US); Patrick Canfield, Dearborn, MI (US); Albert Krause, Plymouth, MI (US); Clay Maranville, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 597 days.

(21) Appl. No.: 10/967,978

(22) Filed: Oct. 19, 2004

(65) Prior Publication Data

US 2006/0086165 A1 Apr. 27, 2006

(51) Int. Cl.
*B21J 15/24* (2006.01)

(52) U.S. Cl. ..... 72/430; 72/56

(58) Field of Classification Search ..... 72/54
See application file for complete search history.

(56) References Cited

U.S. PATENT DOCUMENTS 3,704,506 A * 12/1972 Orr et al. ..... 29/243.54
4,083,918 A * 4/1978 Ronden et al. ..... 264/297.5
4,947,667 A 8/1990 Gunkel et al.
4,990,805 A 2/1991 Zieve
5,113,736 A 5/1992 Meyerle
5,774,968 A 7/1998 Givler
5,813,110 A 9/1998 Arntson et al.

* cited by examiner

*Primary Examiner*—Dana Ross
*Assistant Examiner*—Debra M Sullivan
(74) *Attorney, Agent, or Firm*—Tung & Associates; Raymond L. Coppiellie

(57) ABSTRACT

There is disclosed herein an apparatus for electromagnetic forming of a workpiece with enhancements that increase the durability and overall efficiency of the solenoid coil. The apparatus includes reinforcement members dispersed through the solenoid coil and a cooling system. The apparatus also includes a shaper that varies in girth effectively acting as a force concentrator. The electromagnetic forming device is also capable of incrementally heat treating the workpiece and reducing residual stresses in the workpiece. The invention further discloses a more efficient way of manufacturing the solenoid coil.

17 Claims, 4 Drawing Sheets

APPARATUS FOR ELECTROMAGNETIC FORMING WITH DURABILITY AND EFFICIENCY ENHANCEMENTS

BACKGROUND OF THE INVENTION

1. Field of the Invention

The present invention relates to an apparatus for the electromagnetic forming of materials as well as a method for manufacturing this apparatus.

2. Description of Related Art

Electromagnetic (EM) forming uses the pressure created by a pulsed electromagnetic field in combination with traditional sheet forming technologies on conventional presses to shape materials. An electromagnetic force is defined as a force developed by the passage of an electrical current. EM forming is typically accomplished by the use of an electric current source, a multi-turn solenoid coil and a die. The electrical current leaves from the source at one end of the coil and travels through the coil to the other end. During the high-voltage discharge of capacitors through the coil, a strong electromagnetic field is generated which induces eddy current in the workpiece. The interaction of electromagnetic fields generated by the direct current in the coil and the induced current in the workpiece results in high intensity repelling force, which accelerates the workpiece into the die cavity.

Today, there are two prevalent ways of forming materials using electromagnetic principles. In the more popular method, a shaper generates a secondary electromagnetic field around itself. This electromagnetic field induces the secondary eddy current in the workpiece. As a result of the interaction of the electromagnetic fields, the workpiece repels from the shaper and accelerates toward the corners of a lower die driven by electromagnetic pressure. In another method, the pressure generated by the EM field of the coil acts directly on the workpiece, forcing it against the die.

While electromagnetic forming applications have advantages over conventional forming techniques, including conformance within tighter design dimensions and reducing residual stresses, they also have disadvantages. EM forming applications are limited to production at low volumes since the coils quickly deform due to their low material strength and overheating. Moreover, the workpiece still holds a significant amount of residual stresses that cause it to spring back towards its initial shape. Also, EM forming application can require a substantial amount of electricity and the coils can take a significant amount of time to machine using traditional cutting methods such as end milling. Alternatively, the coil can be formed by winding material into the desired shape; however, this type of coil formation typically results in a less stiff coil having strong residual stresses.

With electromagnetic forming, the coil can be subjected to high stresses during repetitive operations, thus causing the coil to deform. U.S. Pat. No. 3,704,506 suggests using a supportive coil casing to resist the coil's tendency to deform. The use of a casing around the coil is popular but not very effective in increasing the cycle life of the coil. Similarly, U.S. Pat. No. 6,128,935 uses tie rods extending through the coils to resist movement of the coil. However, this arrangement does not provide the coil with enough support as the rods do not extend through the coil and coil casing. Moreover, if the rods are made of conductive material, the coil may short circuit. Therefore, there exists a need to provide adequate reinforcement to the coil permitting higher rates of production.

Moreover, with electromagnetic forming, high temperatures can be generated, thus necessitating a need for cooling the coil. Other designs have attempted to overcome this shortcoming with the use of a cooling agent. U.S. Pat. No. 3,842,630 suggests a method of cooling an EM forming apparatus by routing a cooling agent through a chamber underneath the workpiece. This approach does not actively cool the tool as the working area of the coil is not in direct contact with the coolant. Likewise, U.S. Pat. No. 5,113,736 fails to actively cool the tool as it suggests using a fan that blows air into a cooling housing mounted to the top of the coil. U.S. Pat. No. 3,195,335 discloses pumping coolant through the conductor. This requires the use of a hollowed coil that will have a significantly lower material strength than a filled coil. Moreover, using supportive rods with this coil design is less feasible as the coolant is more likely to leak out of the apertures for the supportive rods. Therefore, there further exists a need to actively cool the tool permitting higher rates of production without overheating.

Residual stresses in materials after forming cause them to spring back to their initial shape. U.S. Patent Application 2003/0182005 A1 attempts to solve this problem by determining a die profile for forming a metal part that will reduce material spring back. However, this method limits the possible shapes that the material can undertake. Therefore, there further exists a need to reduce residual stresses in formed material to prevent spring back.

SUMMARY OF THE INVENTION

Accordingly, the present invention overcomes these problems by providing an electromagnetic forming apparatus capable of producing complex shapes at high volumes. The apparatus of the present invention comprises a multi-turn solenoid coil and reinforcement members that increase the strength of the coil. The apparatus further includes a cooling system minimizing overheating and long-term coil degradation, an electrically insulative shell encasing the coil, and an electromagnetic source electrically connected to the coils for generating a magnetic field.

The present invention further comprises a force concentrator that focuses the pressure resulting from the electromagnetic energy into smaller areas so that the workpiece can be formed into tighter areas. The concentrator includes a nozzle that can be configured in multiple arrangements to accommodate the desired shape of the workpiece.

It is an advantage of the present invention that long-term coil degradation of the coil is minimized by the cooling system of the present invention. In one embodiment, the cooling system cools the coil by removing warm air from the work area utilizing a vacuum arrangement. Moreover, the coolant is not limited to air but can include other gaseous and liquid materials.

The present invention provides an advantage of reducing residual stresses in a workpiece by adjusting the current traveling through the coil so that pulsed electromagnetic pressure is applied to the workpiece.

The present invention provides an additional advantage of heat treating the workpiece prior to forming by adjusting the electric pulse generator of the coil. Such heat treatment can be performed in increments to optimize the formability of the workpiece.

The present invention further provides an advantage of reducing manufacturing time and cost.

These and other advantages of the present invention will become more apparent by the drawings, detailed description, and claims that follow.

DETAILED DESCRIPTION OF THE PREFERRED EMBODIMENTS

Figure 1:
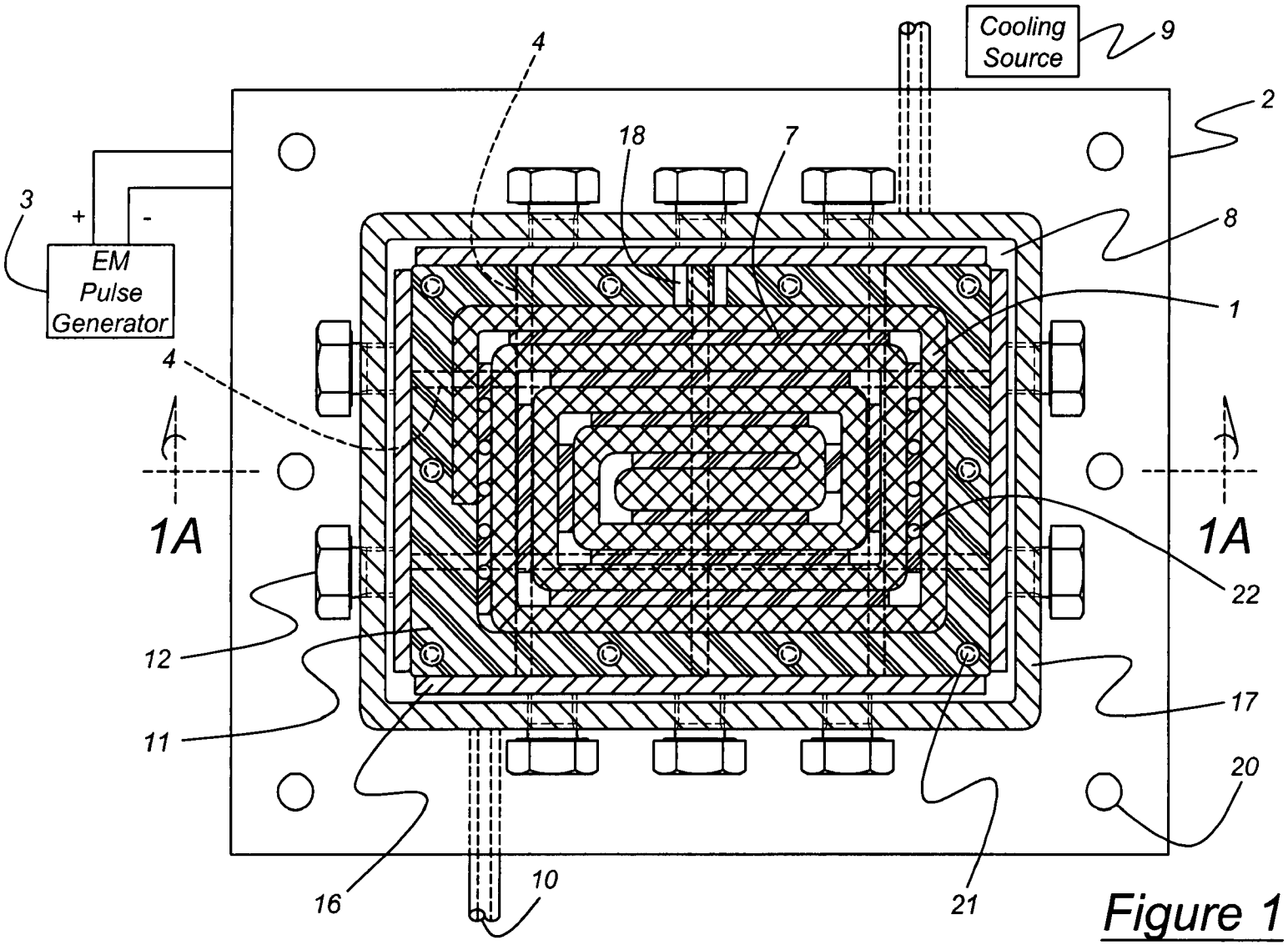
FIG. 1 is a top plan view of an electromagnetic forming device illustrating the reinforcement members relative to the coil and housing unit.

Referring now to the drawings, FIG. 1 illustrates a top plan view of an apparatus for the electromagnetic forming of a workpiece according to the present invention. Generally, electromagnetic forming machines force a workpiece into a die cavity either directly or indirectly by exerting force on a shaper that resultantly forms the workpiece. Electromagnetic Forming ("EMF") will be used to describe all such processes herein.

The electromagnetic forming apparatus shown in FIG. 1 includes a multi-turn solenoid coil 1 framed by a housing unit 2 and insulative members 7 made from an electrically insulative material. The electric current for the EMF operation is generated by the electromagnetic pulse generator 3 and travels through the multi-turn coil 1. The coil 1 is connected to the electromagnetic pulse generator 3 and machined from an electrically conductive material with a high mechanical strength such as cold rolled steel or bronze. To prevent short-circuiting in the coil 1, the turns are spaced at least 2 millimeters apart.

In this arrangement, several non-conductive reinforcement members 4 are placed through the turns of the coil 1 and the insulative members 7 between the coil 1. The reinforcement members 4 serve two primary functions: they prevent the coil 1 from telescoping and they reduce the coil's 1 tendency to expand during operation. The reinforcement members 4 should be composed of non-conductive material since conductive material, like steel, will likely short circuit the coil 1 even when insulated.

The coil 1 is also supported by several other reinforcements along its perimeter. On the outermost perimeter, a steel bandage 17 surrounds the coil 1, steel plates 16, and a non-conductive bed 11. The steel bandage 17, acting to reduce expansion of the coil 1 and cracking of the insulation materials, is secured against the non-conductive bed 11 by bolts 12 that fasten against the steel plates 16.

The non-conductive bed 11 prevents current from traveling through the steel support units. It is made from a non-conductive material like Micarta. The insulative members 7 are machined out of the bed 11 to fit the coil 1. There are apertures 18 in the bed 11 that allow for warm air to exit from the coil 1 surface. To further support coolant flow across the face of the coil 1, the insulative members 7 are spaced so as to create coolant channels 8. The coolant is supplied by a cooling source 9 attached to the inlet apertures 10 symmetrically located at opposite ends of the housing unit 2.

Figure 1A:
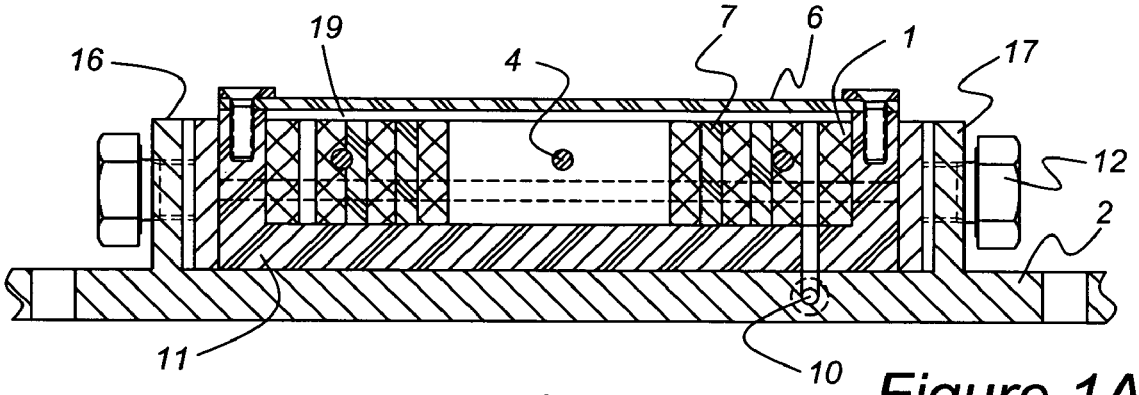
FIG. 1A is a cross-sectional, front view of the electromagnetic forming device of FIG. 1 taken along line 1A-1A and illustrating the components of the cooling unit.

FIG. 1A is a cross-sectional, front view of the arrangement in FIG. 1. The illustration shows the housing unit 2 and the cooling system. The housing unit 2 contains inlet apertures 10 that allow for coolant passage. The coolant may be gaseous or of a liquid variety similar to the liquid coolants widely used in other forming operations. In an apparatus for EMF, the coil 1 is the most loaded element, subject to both mechanical and thermal loads that diminish their durability and efficiency. Elevated coil 1 temperatures decrease the amount of electromagnetic force imparted on the workpiece and multiple thermal cycles can result in micro cracks in the working zone of the coil 1 and higher electrical resistance. To lessen the negative effects of heat build up in the coil 1, coolant is cycled from the inlet apertures 10 at the base of the housing unit 2, through the non-conductive bed 11, across the face of the coil 1, and then out the apertures 18 in the bed 11. An insulative membrane 6 guides the coolant along the face of the coil 1 preventing the coolant from traveling outside of the intended area. The coil 1 is submersed in the coolant providing maximum cooling benefits to the coil 1.

Figure 4:
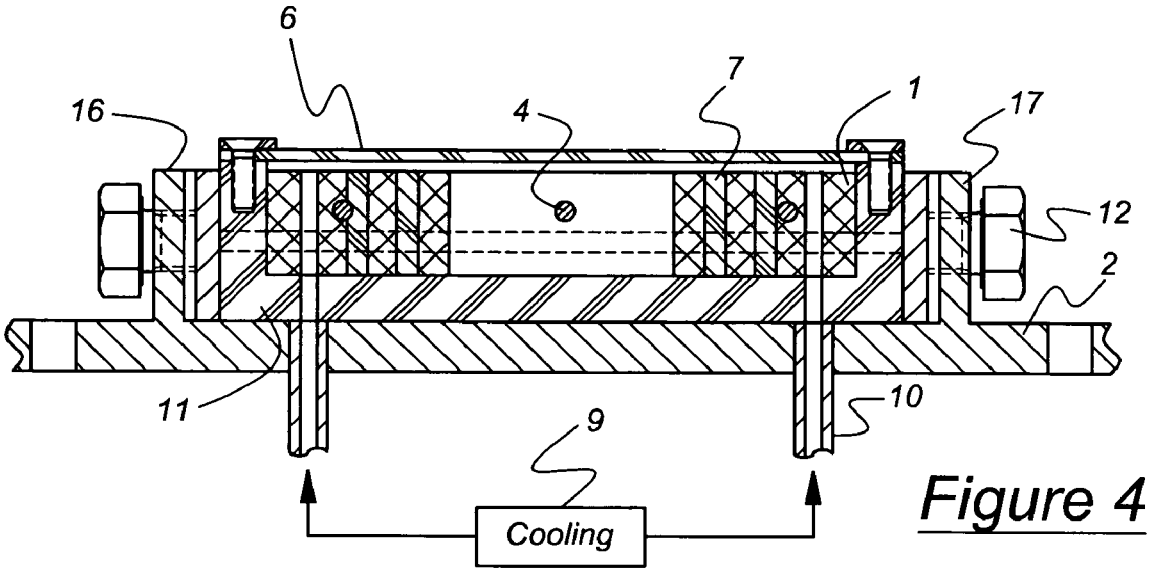
FIG. 4 is a cross-sectional view of an electromagnetic forming device according to another embodiment of the present invention illustrating the components of the cooling unit with an alternative arrangement of inlet apertures.

The membrane 6 should be made of a material that can withstand high temperatures and that is highly insulative, for example a Thermalux film. The membrane 6 is secured to the non-conductive bed 11 by fasteners 21 leaving a finite area 19 for coolant travel. The finite area 19 between the membrane 6 and the coil 1 should be shallow, for example 1 millimeter deep. FIG. 4 is a cross-sectional view of an embodiment similar to that of FIG. 1 with the coolant inlet apertures 10 being located at the bottom of the housing unit 2.

Figure 2:
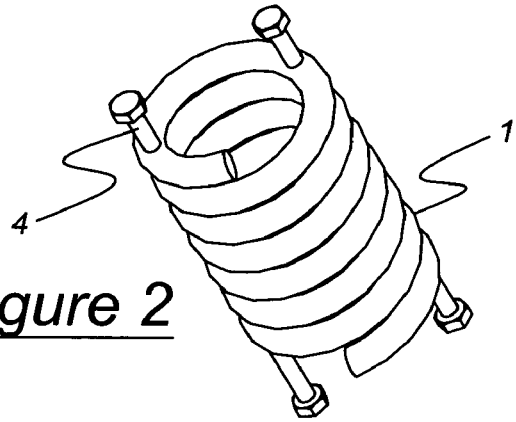
FIG. 2 is a perspective view illustrating an alternative type of solenoid coil with reinforcement members.

The foregoing description of the solenoid coil 1 is merely illustrative of a typical arrangement used for forming of a workpiece. Other coil arrangements, beyond those illustrated in this description, may be used and still come within the scope of this invention. For example, FIG. 2 illustrates an alternative arrangement of a multi-turn solenoid coil 1 with reinforcement members 4. The coil 1 in this embodiment is a cylindrical coil often used in stamping operations that require an upper and lower die. Reinforcement members 4 can be inserted through the turns of the coil 1 in the longitudinal direction to increase the overall strength of the coil 1.

Figure 3:
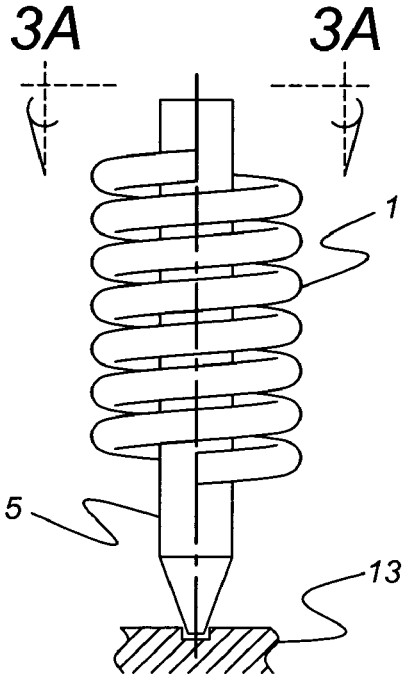
FIG. 3 is a side view of the force concentrator for use in the present invention.
Figure 3A:
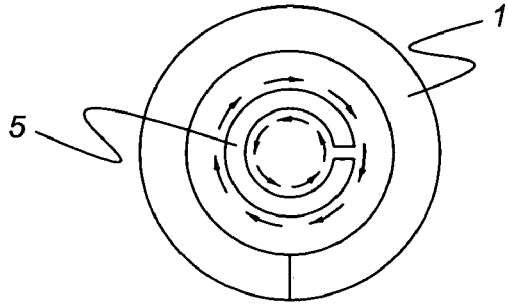
FIG. 3A is a cross-sectional view of FIG. 3 taken along line 3A-3A.

FIG. 3 shows a cylindrical multi-turn solenoid coil 1. A concentrator 5 is essentially a single turn coil that generates a secondary electromagnetic field around itself. This electromagnetic field induces a secondary eddy current in the workpiece. Due to the shorter perimeter of the nozzle of the concentrator 5, the current prefers to travel in the nozzle of the concentrator 5 as opposed to the shaft. As a result of the interaction of the electromagnetic field focused in the nozzle of the concentrator 5, the workpiece accelerates toward the sharp corners of a corresponding lower die 13 driven by the electromagnetic pressure created by the opposing electromagnetic fields. If the shaper were not tapered then it would require a significantly greater amount of energy to force the workpiece into the sharp corners of the lower die 13. The nozzle of the concentrator 5 can take on a variety of shapes depending upon the desired shape of the workpiece.

Figure 5:
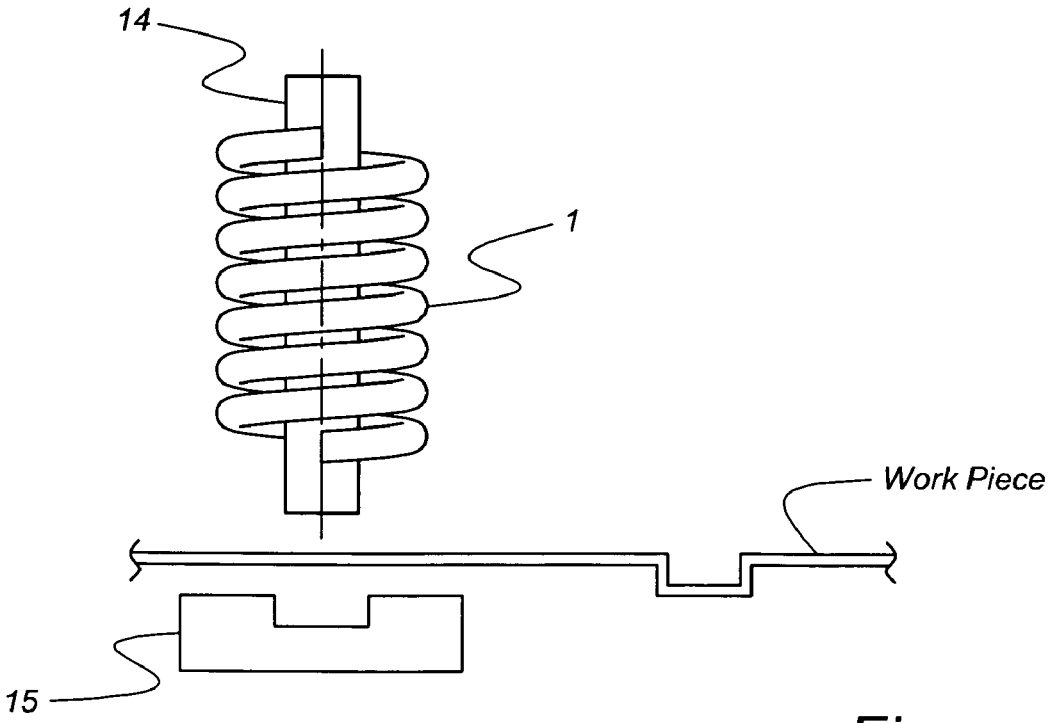
FIG. 5 illustrates an electromagnetic forming device with an upper and lower die.

Turning now to FIG. 5, FIG. 5 shows a forming operation with a shaper 14 and lower die 15. The cylindrical multi-turn solenoid coil 1 surrounds the shaper 14. The shaper 14 generates a secondary electromagnetic field around itself. This electromagnetic field induces the secondary eddy current in the workpiece. As a result of the interaction of the electromagnetic fields, the workpiece repels from the shaper 14 and accelerates towards the lower die 15 driven by electromagnetic pressure, thereby forming the workpiece into the desired shape.

Figure 6:
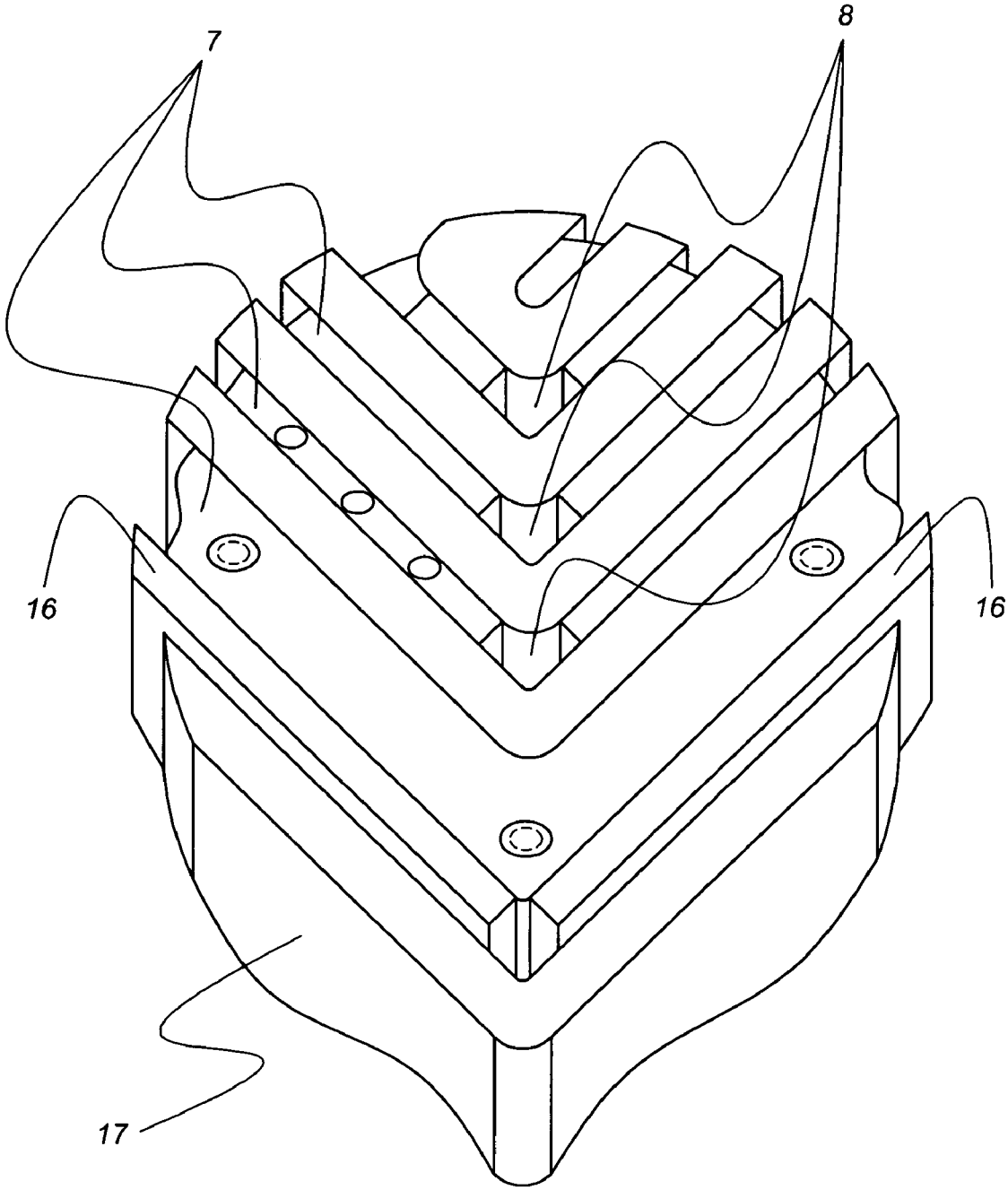
FIG. 6 is a perspective view illustrating the insulation between the turns of the solenoid coil and the coolant channels.

FIG. 6 is a perspective view of the upper right-hand quadrant of the solenoid coil 1 illustrated in FIG. 1. The insulative members 7 rest between the turns of the coil 1 but are gapped at the corners of the coil 1 creating coolant channels 8. In this depiction, the non-conductive bed 11, steel plates 16, and steel bandage 17 also reinforce the coil 1.

Additionally, the apparatus of the present invention is capable of reducing the spring back effect in a formed workpiece. During the discharge, pulsed electromagnetic pressure is applied to the workpiece. Elastic waves propagate multiple times through the thickness of the workpiece thereby relieving the residual stresses that cause the workpiece to spring back.

Heat treating metals in increments before the forming process can significantly enhance their formability. The electromagnetic forming device of the present invention is also capable of heat treating the workpiece before forming. The solenoid coil 1 can be used to generate heat by switching the pulse generator 3 to an induction current generator. In one example, heat treatment by the coil 1 of prestrained AA5754 samples at 600° C. for two minutes provided almost full recovery of material formability and reduced the yield strength to the annealed level. In another example, heat treatment of prestrained AA6111-T4 samples at 250° C. during 30 seconds recovered a significant part of material formability and did not affect the paint bake response. This process is capable of increasing the plane strain deformation from 25% in as-received sheet to 45% in incrementally formed sheet.

Solenoid coils can be machined using a number of manufacturing methods. Machining by waterjet is by far the most efficient means of doing so. Water is pressurized typically between 20,000 and 55,000 pounds per square inch (PSI) and forced through an orifice between 0.010" to 0.015" in diameter. Coils machined by waterjet take a fraction of the time it takes to machine similar coils using end milling or laser cutting technologies. Moreover, waterjet machining is more advantageous than other methods as the tool never gets dull and it cannot overheat. This single cutting process saves material costs and machining costs.

It will be realized, however, that the foregoing specific embodiments have been shown and described for the purpose of illustrating the functional and structural principles of the invention and are subject to change without departure from such principles. Therefore, this invention includes all modifications encompassed within the scope of the following claims.

What is claimed is:

1. An apparatus for electromagnetic forming a workpiece, comprising:

a multi-turn solenoid coil operative to generate an electromagnetic force against said workpiece;

a housing unit supporting said coil;

an electromagnetic pulse generator connected to the coil and operative to generate an electromagnetic field;

a plurality of reinforcement members disposed through said coil and operative to prevent deformation of said coil during a forming operation;

a cooling system for passing coolant across the coil;

said multi-turns in said coil separated by a predetermined distance wherein adjacent turns of said multi-turns in said coil are separated by a gap larger than 2 millimeters;

said coil operative to generate a predetermined amount of heat energy so as to heat said workpiece according to a predefined heat treatment process; and said coil includes a plurality of apertures extending through the turns of the coil along transverse, longitudinal or radial directions of said coil and that are operative to receive said reinforcement members.

2. The apparatus of claim 1, wherein said apertures are disposed along a transverse edge of said coil.

3. The apparatus of claim 2, wherein said apertures are disposed along a longitudinal edge of said coil.

4. The apparatus of claim 1, wherein said coil includes an insulative member disposed between each of the said multi-turns of the coil.

5. The apparatus of claim 4, wherein said coil is formed using water, laser or end-mill cutting process.

6. The apparatus of claim 1, wherein said electromagnetic pulse generator is capable of generating a predetermined electromagnetic force operative to relieve residual stress and compensate for spring-back effect in said workpiece.

7. The apparatus of claim 1, wherein said reinforcement members are composed of or embedded in a non-conductive material.

8. The apparatus of claim 7, wherein said reinforcement members are disposed through said plurality of apertures in said coil and are secured against said housing.

9. The apparatus of claim 1, further comprising an electrically insulative shell disposed between the multi-turns of said coil.

10. The apparatus of claim 9, wherein said electrically insulative material includes channels for coolant passage.

11. The apparatus of claim 10, wherein said cooling system further comprises a cooling source with inlet and outlet apertures.

12. The apparatus of claim 11, wherein said cooling system further comprises a membrane attached to said housing unit at a predetermined length from the coil and that is operative to restrict coolant flow.

13. The apparatus of claim 4, wherein said housing further includes a non-conductive bed disposed between said coil and said housing and sized to receive said coil and said insulative members between coil turns therein.

14. The apparatus of claim 13, wherein said bed is made of Micarta.

15. The apparatus of claim 14, wherein said bed further includes inlet and outlet apertures to allow for coolant passage.

16. The apparatus of claim 15, wherein said bed further includes fasteners for securing bed and coil.

17. The apparatus of claim 15, wherein said bed further includes reinforcement members projecting through said housing which are secured thereagainst.

* * * * *